US007523809B2

(12) United States Patent
Monzón-Simón et al.

(10) Patent No.: US 7,523,809 B2
(45) Date of Patent: Apr. 28, 2009

(54) ELEVATOR TOP OF CAR SAFETY

(75) Inventors: Andrés Monzón-Simón, Madrid (ES); Julián Cabañas Falcón, Madrid (ES); Fernando Del Rio Sanz, Torrelodones (ES); Antonio De Miguel Urquijo, Madrid (ES); Francisco Luis Sanz Delgado, Madrid (ES); Herbert Horbrügger, Berlin (DE); Peter Leo Herkel, Berlin (DE); Dirk Heinrich Tegtmeier, Berlin (DE)

(73) Assignee: Otis Elevator Company, Farmington, CT (US)

( * ) Notice: Subject to any disclaimer, the term of this patent is extended or adjusted under 35 U.S.C. 154(b) by 468 days.

(21) Appl. No.: 10/592,909

(22) PCT Filed: Apr. 30, 2004

(86) PCT No.: PCT/IB2004/001582

§ 371 (c)(1),
(2), (4) Date: Sep. 15, 2006

(87) PCT Pub. No.: WO2005/105645

PCT Pub. Date: Nov. 10, 2005

(65) Prior Publication Data

US 2008/0245619 A1 Oct. 9, 2008

(51) Int. Cl.

| | |
|---|---|
| ***B66B 5/00*** | (2006.01) |
| ***B66B 9/00*** | (2006.01) |
| ***B66B 13/00*** | (2006.01) |
| ***B66B 11/00*** | (2006.01) |

(52) U.S. Cl. ..... 187/401; 187/314; 187/414; 182/148

(58) Field of Classification Search ..... 187/249, 187/277, 314, 316, 356, 360, 371, 377, 401, 187/414; 182/13, 19, 113, 148
See application file for complete search history.

(56) References Cited

U.S. PATENT DOCUMENTS

| | | | | |
|---|---|---|---|---|
| 6,138,798 | A * | 10/2000 | Macuga | 187/294 |
| 6,173,814 | B1 * | 1/2001 | Herkel et al. | 187/288 |
| 6,481,534 | B1 * | 11/2002 | Malone, Jr. | 187/377 |
| 6,550,585 | B2 * | 4/2003 | Schoppa et al. | 187/391 |

(Continued)

FOREIGN PATENT DOCUMENTS

DE 10052459 A1 * 5/2002

(Continued)

OTHER PUBLICATIONS

Office Action dated Jan. 9, 2009 issued in Chinese Counterpart Application No. 200480042916.8.

(Continued)

*Primary Examiner*—T C Patel
*Assistant Examiner*—Eduardo Colon-Santana

(57) ABSTRACT

An elevator car (2) comprises a cover (14; 40) extending over at least a portion of the top surface of the car (24). The cover (14; 40) is mounted on a resilient support (28, 42). The car (2) further comprises means (32; 44) for detecting displacement of the cover corresponding to the weight of a person being applied to the cover. If such displacement is detected, normal operation of the car (2) is prevented.

11 Claims, 4 Drawing Sheets

U.S. PATENT DOCUMENTS

| | | | | |
|---|---|---|---|---|
| 7,140,473 | B2 * | 11/2006 | Det et al. | 187/401 |
| 7,281,609 | B2 * | 10/2007 | Del Rio Sanz et al. | 187/316 |
| 2007/0240942 | A1 * | 10/2007 | Sirigu | 187/360 |
| 2008/0047783 | A1 * | 2/2008 | Vogl | 187/314 |

FOREIGN PATENT DOCUMENTS

| | | | | |
|---|---|---|---|---|
| EP | 1167268 | A1 | * | 1/2002 |
| EP | 1 386 876 | A1 | | 2/2004 |
| GB | 2158038 | A | * | 11/1985 |
| GB | 2 379 654 | A | | 3/2003 |
| JP | 02291377 | A | * | 12/1990 |
| JP | 08310771 | | | 11/1996 |
| JP | 2001-247272 | A | | 9/2001 |
| JP | 2002-020062 | | | 1/2002 |
| JP | 2002003113 | A | * | 1/2002 |
| JP | 2006199404 | A | * | 8/2006 |

OTHER PUBLICATIONS

PCT International Preliminary Report on Patentability for PCT/IB2004/001582, dated Jul. 17, 2006.

* cited by examiner

FIG. 1
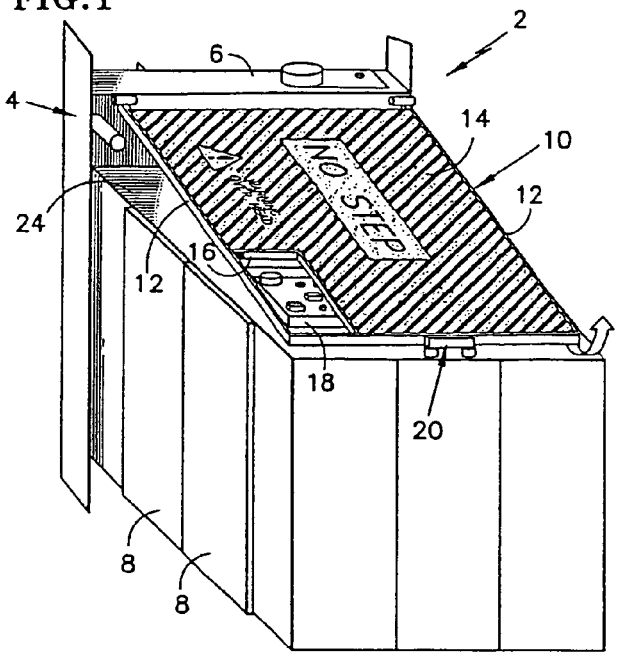
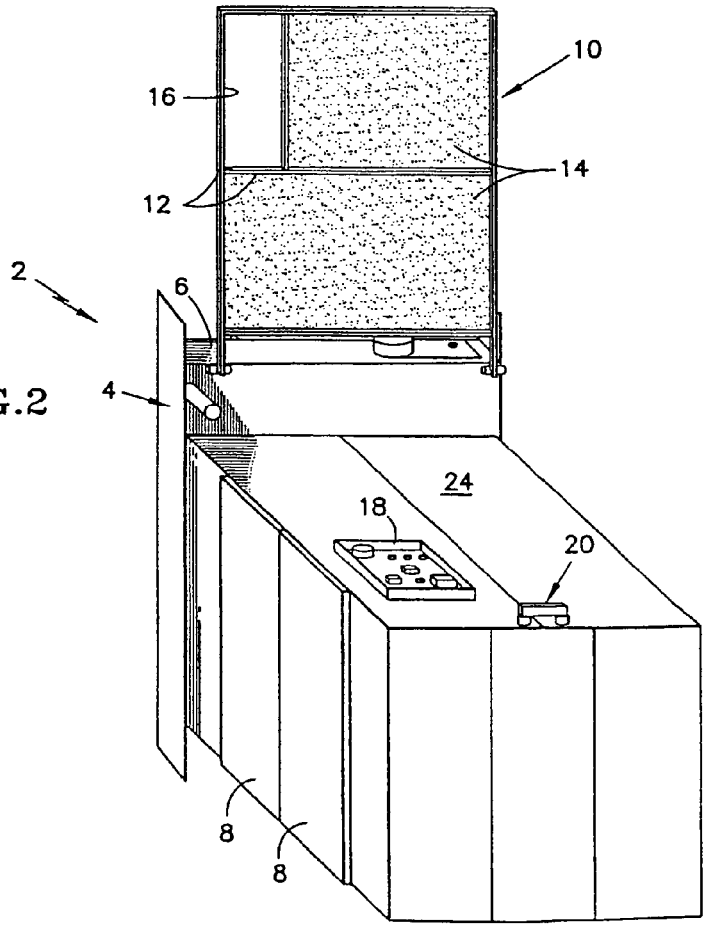
FIG. 2

FIG.3
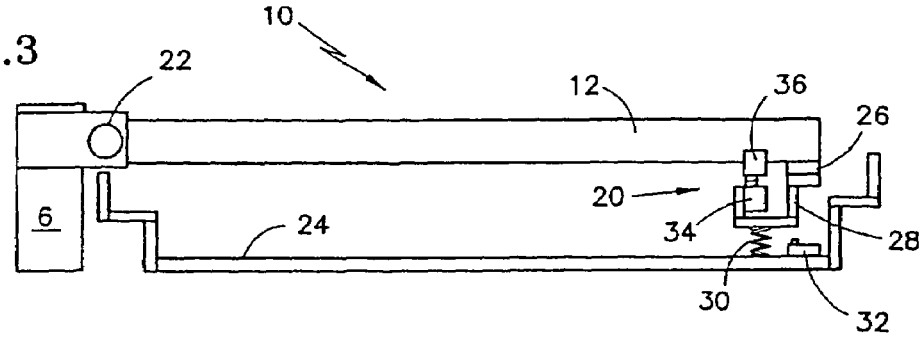
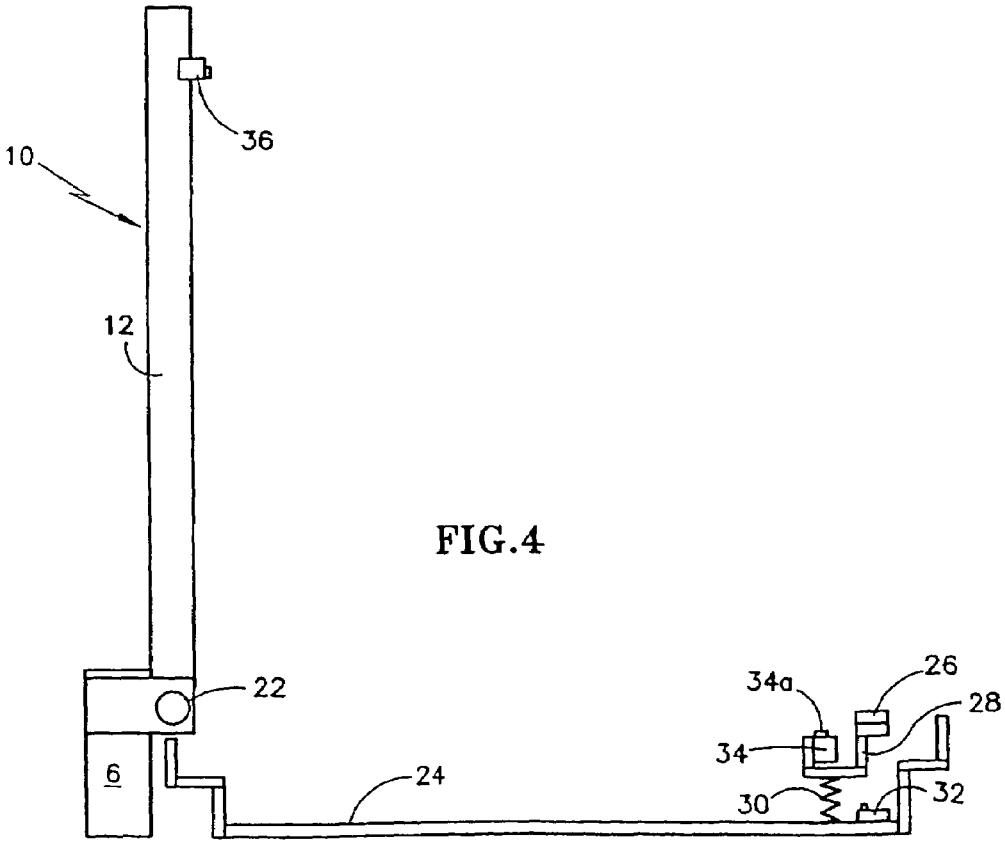
FIG.4

ELEVATOR TOP OF CAR SAFETY

FIELD OF THE INVENTION

This invention relates to systems for detecting the unauthorised or improper presence of persons on top of an elevator car so that normal operation may be suspended to prevent injury.

DESCRIPTION OF THE RELATED ART

In low overhead elevator systems it is essential from a safety point of view that it is impossible for a person to be present on top of the car during normal operation of the elevator since such systems typically do not provide enough space for a person between the top of the car and the hoistway ceiling when the car is at the uppermost landing level.

It is known to provide various safety measures for preventing normal operation of the car during an inspection by an authorised engineer. Such measures however tend to be dependent upon proper deployment by the engineer and are therefore not fail-safe. Furthermore, they do not provide protection in the event that an unauthorised person gains access to the top of the car.

In one example, whilst it has previously been proposed to provide a retractable balustrade on the top of the car, deployment of which puts the car in to inspection mode, these tend to be of an open frame structure and the Applicant has therefore appreciated that a person could clamber over the balustrade without deploying it and thus dangerously ride the top of the car.

SUMMARY OF THE INVENTION

It is an object of the present invention to increase the safety of elevator systems, particularly machine room-less elevators.

In accordance with the present invention there is provided an elevator car comprising a cover extending over at least a portion of the top surface of the car, said cover being mounted on a resilient support; the car further comprising detection means for detecting displacement of the cover corresponding to a weight exceeding a predetermined threshold being applied to the cover, the car being arranged so as to prevent normal operation if said displacement has been detected.

Thus it will be seen by those skilled in the art that in accordance with the invention a weight-sensitive cover is provided on the top of the elevator car which is able to detect a person climbing on top of the car and thus suspend the car's normal operation. Thus a fail-safe arrangement is provided that will reduce the danger faced by any person who accesses the top of the car without undertaking the necessary procedure for putting the car into a safe inspection mode.

In some envisaged embodiments the cover comprises a false ceiling over at least a substantial portion of the top of the car such that the detection means would be activated whenever a person got or top of the car whether authorised or not. Of course if the access is by an authorised engineer, inspection mode may still be available even if ordinary operation is not.

In presently preferred embodiments, the cover is provided on or by a retractable balustrade. By providing the balustrade as a cover, rather than the more usual open-frame structure, it may be used to perform the aforementioned car top detection function since the closed configuration prevents a person from being able to stand on the car top between the struts of an open frame.

Where the cover comprises a retractable balustrade, the car is preferably provided with means for detecting deployment of the balustrade also to prevent normal operation of the car and/or to put the car into inspection mode.

The cover could be rigidly attached to the balustrade such that downward pressure thereon is transmitted to the balustrade. Downward movement of the balustrade as a whole may then be used to detect the weight of a person on top of the car. Alternatively the cover could be resiliently attached to the balustrade such that relative movement between them is used to detect the weight of a person.

The cover may cover just a part of the top of the car e.g. in the area closest to where it might be accessed from a landing, but preferably the cover is arranged over substantially the whole area of the top of the car on which a person could stand. In preferred embodiments having this feature, however, a cut-away portion is provided in the cover to allow access to certain controls mounted on the car top e.g. for switching between inspection and ordinary operation and/or a stop button. In the preferred embodiment however controls for operating the elevator in inspection mode are obscured. This provides further encouragement to deploy the safety balustrade for anyone on top of the car attempting to operate the car in inspection mode.

The detection means is preferably arranged to be latched such that ordinary operation of the car is prevented until the latch is properly reset by an authorised user. The reset could, for example, be carried out remotely in an area accessible only to authorised persons and/or could involve a key-operated switch.

In accordance with the invention the cover is resiliently supported with a resilient force such that the weight of a person on the cover overcomes the force to operate the detection means. In certain preferred embodiments detent means are provided for preventing movement of the cover unless it is properly displaced by a person clambering on it. Such a detent is advantageous since it would reduce the possibility of the detection means inadvertently disrupting normal operation of the car resulting from vibration or sudden acceleration/deceleration in normal use. It also has the advantage that a lower force spring can be used. A detent would also reduce noise arising from movement of the cover during normal operation.

A suitable detent could be in the form of a purely mechanical arrangement but it is preferred that it comprises a magnet.

BRIEF DESCRIPTION OF THE DRAWINGS

Certain preferred embodiments of the invention will now be described, by way of example only, with reference to the accompanying drawings in which:

FIG. 1 is a perspective view of an elevator car in accordance with an embodiment of the invention;

FIG. 2 is a perspective view of the car of FIG. 1 with the balustrade in the deployed position;

FIG. 3 is a partial sectional view through the car ceiling and retracted balustrade as in FIG. 1;

FIG. 4 is a view similar to FIG. 3 showing the balustrade deployed as in FIG. 2;

DETAILED DESCRIPTION

Figure 5:
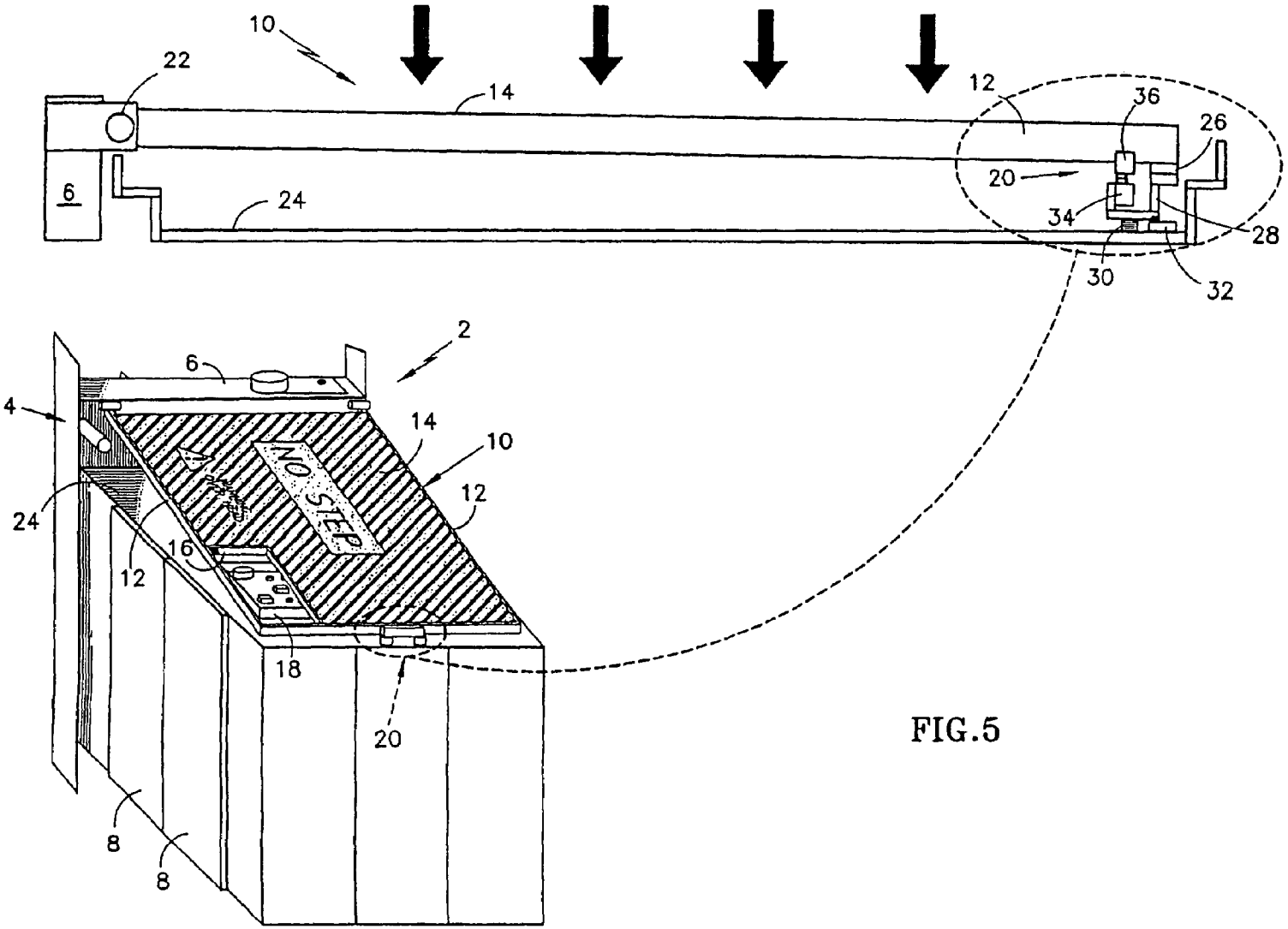
FIG. 5 is a perspective and corresponding partial sectional view showing the effect of an unauthorised person stepping on the balustrade cover.

Turning firstly to FIG. 1 there may be seen an elevator car 2 which is suspended in a so-called rucksack suspension configuration. A rucksack frame 4 is therefore provided on one side of the elevator and incorporates a cross-head 6. A pair of sliding doors 8 is provided at the front of the elevator car.

Hingedly mounted to the cross head 6 is a retractable balustrade 10. However, rather than being of an open frame construction as in previous proposals, the balustrade frame 12 is covered by a thin metallic cover 14 over most of its area. The cover 14 is cut away in one corner thereof in order to enable access to the top of car inspection (TOCI) box 16 on the roof of the car. More specifically, the cut-away 16 allows access to the switch for switching between normal and inspection operation of the car and the stop switch but prevents access to buttons for operating the car up and down in inspection mode. Thus the car may only be moved in inspection mode once the balustrade has been deployed.

The edge of the balustrade 10 furthest from its hinges rests on a balustrade switch assembly 20 to allow detection of when the balustrade 10 is deployed as shown in FIG. 2.

The balustrade switch assembly 20 is shown in greater detail in FIGS. 3 and 4. FIG. 3 shows the side of the balustrade frame 12 which is mounted to the cross head 6 of the car frame by a hinge mounting 22. The balustrade 10 therefore lays over the ceiling of the car 24.

The distal edge of the balustrade frame 12 rests on a magnet 26 which is supported by a floating bracket 28. The floating bracket 28 is, in turn, mounted for vertical movement on a set of vertical guides (not shown) by a compression spring 30. The spring 30 holds the floating brackets 28 away from a microswitch 32 mounted on the car ceiling 24. The floating bracket 28 itself carries a second microswitch 34 which is engaged by a peg 36 attached to the balustrade frame 12 so as to press the microswitch actuator 34*a* (FIG. 4) in whilst the balustrade is in the retracted position of FIG. 3.

Operation of the arrangements described above will now be described with reference to FIGS. 1 to 5. During normal operation, the balustrade 10 is held in the deployed position shown in FIGS. 1 and 3 by the magnet 26. The strength of the magnet 26 is such as to prevent detachment of the balustrade frame 12 under the inertias encountered during ordinary operation and also during safety tripping. Whilst the balustrade 10 is in this retracted position, the microswitch 34 is held closed which permits ordinary operation of the elevator car.

When servicing or inspection by an authorised engineer is required, he or she will obtain access to the hoistway and the top of the car using the normal procedure e.g. entering from one of the landings. Before clambering on top of the car, the engineer will access the TOCI box 18 through the cut-away 16 in the balustrade cover 14. Using this the engineer will put the car into inspection mode, thereby suspending ordinary operation. Thereafter the engineer pivots the balustrade up into a vertical position as shown in FIGS. 2 and 4. This releases the balustrade microswitch 34 and therefore allows operation of the car in inspection mode. It also allows physical access to the up, down and common control buttons on the TOCI box 18. Movement of the car may thus now be controlled by the TOCI box 18 and the car will not be permitted to ascend to the very top of its travel where the available head room would be insufficient safely to accommodate an engineer standing on top of the car. The car could of course be arranged such that inspection operation is only permitted (as compared to no operation of the car) when further safety devices have been deployed.

Once the engineer has finished, the balustrade is returned, the microswitch 34 closed and the car switched back to normal operation by operating the TOCI box 18 through the cut out 16 in the cover 14.

In the event that an unauthorised person manages to gain access to the top of the car or an engineer does not follow the correct procedures for riding the car, he or she will stand on the cover 14 which is attached to the balustrade frame 12. Application of a force corresponding to a person's weight to the cover 14 will compress the spring 30 holding the floating brackets 28 to such an extent that the floating bracket 28 will engage and operate the microswitch 32 mounted to the car ceiling 24. This is shown in FIG. 5.

When the microswitch 32 is actuated, operation of the car is immediately suspended. The potential for injury to the person on top of the car by striking the top of the hoistway as the car reaches the uppermost landing is thereby avoided. A latch arrangement is associated with the emergency stop system initiated by the microswitch 32 which must be reset by an authorised person. The reset could, for example, be by a key switch located in the hallway or some other control accessible only to authorised persons. Since the cover 14 extends across substantially all of the top of the car, it is very unlikely that a person would be able to ride the top of the car without applying their weight to the cover and thereby deactivating the elevator system.

Figure 6:
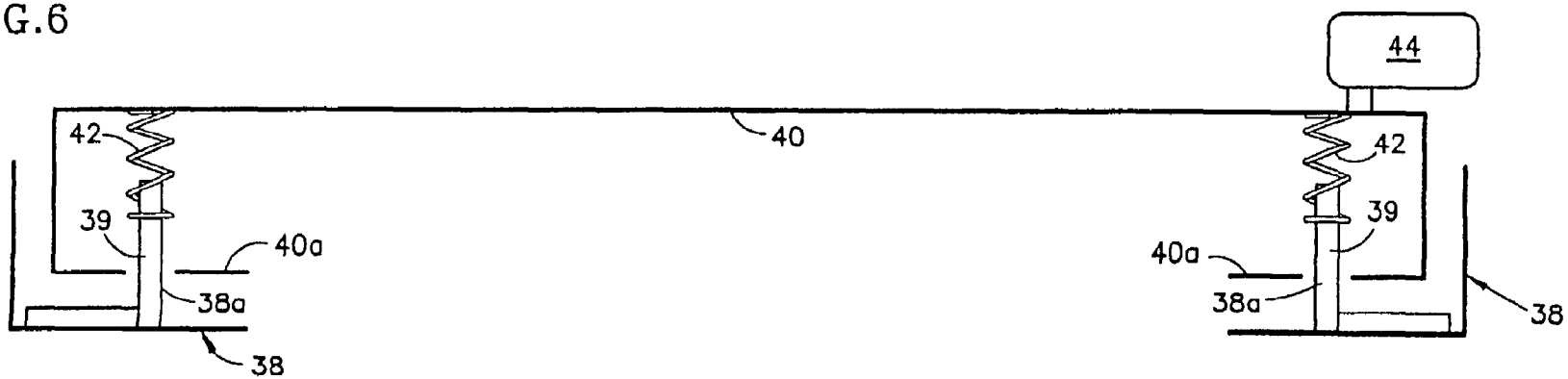
FIG. 6 is a sectional view through a second embodiment of the invention.

A further embodiment of the invention will now be described with reference to FIGS. 6 and 7. In this embodiment, the balustrade frame 38 has an upwardly-open box-section profile. Rather than being rigidly fixed to the balustrade frame 38, the cover 40 is mounted to the inner walls 38*a* of respective box-section frame members by a plurality of compression springs 42. The sides of the cover member 40 extend vertically downwards and then turn in so as to form a flange 40*a* parallel to the upper surface. The flange 40*a* is provided with apertures to allow the vertical posts 39 to pass through. The arrangement is therefore such that the cover member 40 is resiliently supported on these springs 42 away from contact with the balustrade frame 38. A microswitch 44 mounted to the balustrade frame (by means not shown) is arranged to be operated by the cover member when it is in this position.

Figure 7:
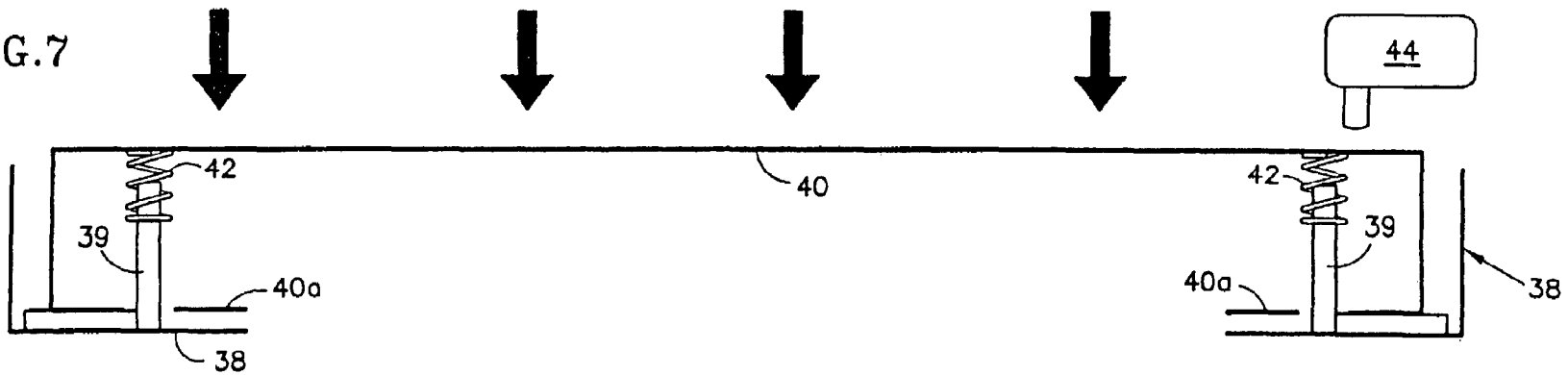
FIG. 7 is a sectional view similar to FIG. 6 showing the effect of an unauthorised person standing on the cover.

When the weight of a person is applied to the cover 40 as shown in FIG. 7, the springs 42 supporting it are compressed allowing the cover to move downwardly so that the lower flanges 40*a* rest on the inner faces of the balustrade frame 38. This moves the cover 40 away from the microswitch 44 thus releasing its button. This generates a signal which is then used to suspend operation of the car as described with reference to the previous embodiment.

It will be appreciated by those skilled in the art that only certain specific embodiments of the invention have been described whereas many possible embodiments are possible. For example, it is not essential to provide a retractable balustrade in order to practice this invention and the cover could be mounted on the ceiling of the car instead.

The invention claimed is:

1. An elevator car comprising a cover extending over at least a portion of the top surface of the car, said cover being mounted on a resilient support; the car further comprising detection means for detecting displacement of the cover corresponding to a weight exceeding a predetermined threshold being applied to the cover, the car being arranged so as to prevent normal operation if said displacement has been detected; wherein said cover is provided on a retractable balustrade.

2. An elevator car as claimed in claim 1 wherein said cover and said retractable balustrade form a single unit.

3. An elevator car as claimed in claim 1 comprising means for detecting deployment of the balustrade.

4. An elevator car as claimed in claim 1 wherein the cover is rigidly attached to the balustrade.

5. An elevator car as claimed in claim 1 wherein the cover is resiliently attached to the balustrade.

6. An elevator car as claimed in claim 1 wherein the balustrade when retracted is arranged over substantially the whole area of the top of the car on which a person could stand.

7. An elevator car as claimed in claim 6 comprising a cut-away portion provided in the cover to allow access to controls mounted on the car top.

8. An elevator car as claimed in claim 7 wherein said cut-away portion does not provide access to controls for controlling movement of the car during inspection mode.

9. An elevator car as claimed in claim 1 wherein the detection means is arranged to be latched such that ordinary operation of the car is prevented until the latch is reset.

10. An elevator car as claimed in claim 1 comprising detent means for preventing movement of the cover unless the cover is displaced.

11. An elevator car as claimed in claim 10 wherein said detent means comprises a magnet.

* * * * *